US006203399B1

(12) United States Patent
Hackney

(10) Patent No.: US 6,203,399 B1
(45) Date of Patent: Mar. 20, 2001

(54) ABSORBENT PAD FOR TORSO AREA BENEATH BREASTS

(75) Inventor: Cleo A. Hackney, Springtown, TX (US)

(73) Assignee: Frances Victoria Russell, Desoto, TX (US)

( * ) Notice: Subject to any disclaimer, the term of this patent is extended or adjusted under 35 U.S.C. 154(b) by 0 days.

(21) Appl. No.: 09/621,989

(22) Filed: Jul. 21, 2000

(51) Int. Cl.[7] ..... A41C 3/00

(52) U.S. Cl. ..... 450/1; 450/57; 2/56; 2/267; 2/46; 2/50

(58) Field of Search ..... 450/86, 53, 56, 450/57, 60, 61, 67, 80, 81; 2/73, 267, 268, 53, 56, 57, 1, 455, 463, 46, 50, 60

(56) References Cited

U.S. PATENT DOCUMENTS 2,258,277 * 10/1941 Bullinger ..... 450/60
2,505,720 * 4/1950 Peiser et al. ..... 450/1
3,164,155 * 1/1965 Simonsen ..... 450/60
3,200,413 * 8/1965 Vaughan ..... 2/53
3,402,719 * 9/1968 Simonsen ..... 450/60
3,642,009 * 2/1972 Nobbs ..... 450/60
3,890,978 * 6/1975 Nobbs ..... 450/61
4,747,162 * 5/1988 Yanagihara ..... 2/53
5,716,255 * 2/1998 Abercrombie et al. ..... 450/60

* cited by examiner

*Primary Examiner*—Gloria M. Hale

(57) ABSTRACT

An absorbent pad for torso area beneath breasts for absorbs moisture and protects outer garments from perspiration. The absorbent pad for torso area beneath breasts includes an elongate pad member formed from an absorbent material and having a notch extending from a medial portion of a top edge of the pad member adapted for aligning between the cups of a bra.

16 Claims, 2 Drawing Sheets

10
20
3
3
36
30

38

ABSORBENT PAD FOR TORSO AREA BENEATH BREASTS

BACKGROUND OF THE INVENTION

1. Field of the Invention

The present invention relates to breast pads and more particularly pertains to a new absorbent pad for torso area beneath breasts for absorbs moisture and protects outer garments from perspiration.

2. Description of the Prior Art

The use of breast pads is known in the prior art. More specifically, breast pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,603,653; 4,193,404; 5,149,336; 5,690,536; 5,858,014; and U.S. Pat. No. Des. 342,785.

While these devices fulfill their respective, particular objectives and requirements, the aforementioned patents do not disclose a new absorbent pad for torso area beneath breasts. The inventive device includes an elongate pad member formed from an absorbent material and having a notch extending from a medial portion of a top edge of the pad member adapted for aligning between the cups of a bra.

In these respects, the absorbent pad for torso area beneath breasts according to the present invention substantially departs from the conventional concepts and designs of the prior art, and in so doing provides an apparatus primarily developed for the purpose of absorbs moisture and protects outer garments from perspiration.

SUMMARY OF THE INVENTION

In view of the foregoing disadvantages inherent in the known types of breast pads now present in the prior art, the present invention provides a new absorbent pad for torso area beneath breasts construction wherein the same can be utilized for absorbs moisture and protects outer garments from perspiration.

The general purpose of the present invention, which will be described subsequently in greater detail, is to provide a new absorbent pad for torso area beneath breasts apparatus and method which has many of the advantages of the breast pads mentioned heretofore and many novel features that result in a new absorbent pad for torso area beneath breasts which is not anticipated, rendered obvious, suggested, or even implied by any of the prior art breast pads, either alone or in any combination thereof.

To attain this, the present invention generally comprises an elongate pad member formed from an absorbent material and having a notch extending from a medial portion of a top edge of the pad member adapted for aligning between the cups of a bra.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new absorbent pad for torso area beneath breasts apparatus and method which has many of the advantages of the breast pads mentioned heretofore and many novel features that result in a new absorbent pad for torso area beneath breasts which is not anticipated, rendered obvious, suggested, or even implied by any of the prior art breast pads, either alone or in any combination thereof.

It is another object of the present invention to provide a new absorbent pad for torso area beneath breasts which may be easily and efficiently manufactured and marketed.

It is a further object of the present invention to provide a new absorbent pad for torso area beneath breasts which is of a durable and reliable construction.

An even further object of the present invention is to provide a new absorbent pad for torso area beneath breasts which is susceptible of a low cost of manufacture with regard to both materials and labor, and which accordingly is then susceptible of low prices of sale to the consuming public, thereby making such absorbent pad for torso area beneath breasts economically available to the buying public.

Still yet another object of the present invention is to provide a new absorbent pad for torso area beneath breasts which provides in the apparatuses and methods of the prior art some of the advantages thereof, while simultaneously overcoming some of the disadvantages normally associated therewith.

Still another object of the present invention is to provide a new absorbent pad for torso area beneath breasts for absorbs moisture and protects outer garments from perspiration.

Yet another object of the present invention is to provide a new absorbent pad for torso area beneath breasts which includes an elongate pad member formed from an absorbent material and having a notch extending from a medial portion of a top edge of the pad member adapted for aligning between the cups of a bra.

Still yet another object of the present invention is to provide a new absorbent pad for torso area beneath breasts that does not produce additional contour lines visible through the outer layers of clothing.

Even still another object of the present invention is to provide a new absorbent pad for torso area beneath breasts that reduces the moisture on a users bra commonly present after exercise or hot flashes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
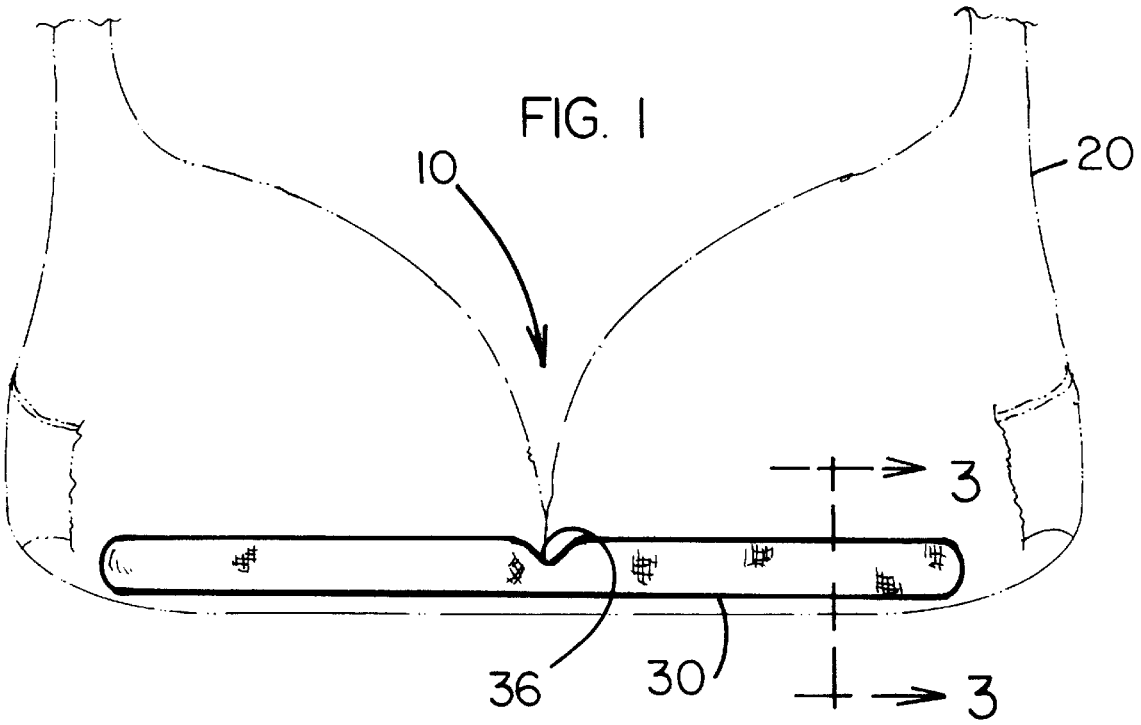
FIG. 1 is a schematic front view of a new absorbent pad for torso area beneath breasts according to the present invention.
Figure 2:
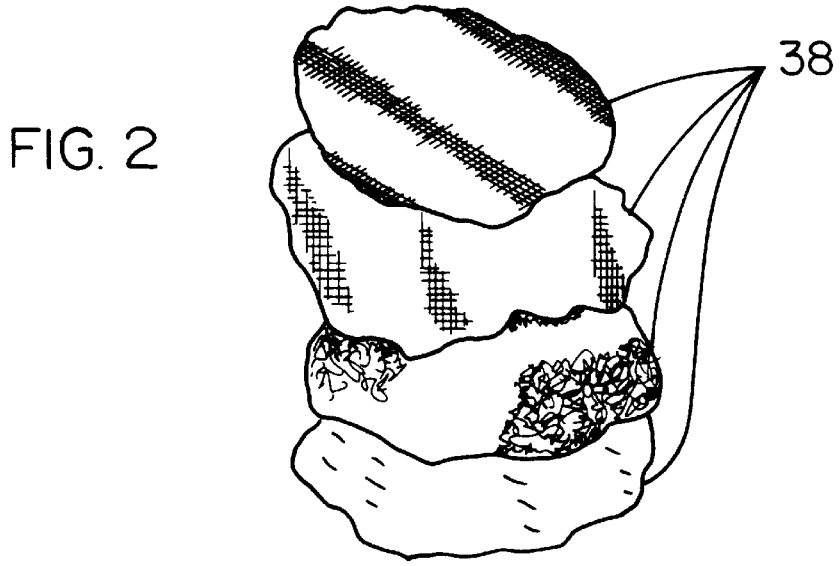
FIG. 2 is a schematic cross-sectional view of the pad member present invention.
Figure 3:
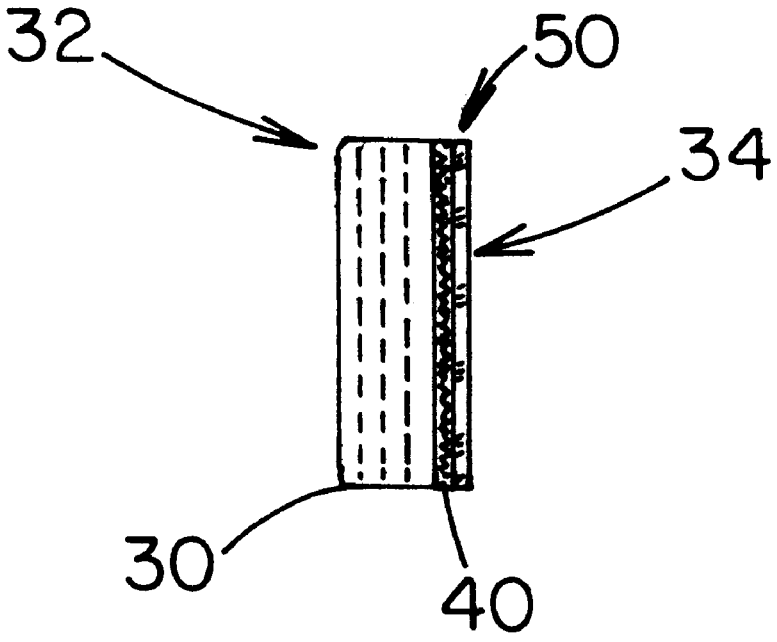
FIG. 3 is a schematic cross-sectional view of the present invention taken along line 3—3 of FIG. 1.

With reference now to the drawings, and in particular to FIGS. 1 through 3 thereof, a new absorbent pad for torso area beneath breasts embodying the principles and concepts of the present invention and generally designated by the reference numeral 10 will be described.

As best illustrated in FIGS. 1 through 3, the absorbent pad for torso area beneath breasts 10 generally comprises An absorbent pad and bra system comprising a bra 20, an elongate pad member 30, an adhesive 40 and a backing member 50.

The bra 20 is designed for wearing by a human. The bra 20 includes a lower front edge designed for positioning against a torso of a wearer beneath breasts of the wearer.

The elongate pad member 30 is formed from an absorbent material.

The adhesive 40 is coupled to a first face 34 of the pad member 30 for removably coupling the first face 34 to the lower front edge of the bra 20 such that a second face 32 of the pad member 30 is positioned to abut the torso of a wearer of the bra 20 beneath breasts of the wearer.

The backing member 50 is removably coupled to the first face 34 of the pad member 30 for covering the adhesive 40 to preserve the adhesive 40 prior to the pad member 30 being coupled to the bra 20.

The pad member 30 includes a single generally V-shaped notch 36 extending inwardly from a center portion of a top edge of the pad member 30. The notch 36 is for aligning the pad member 30 between the pair of cups of the bra 20 for facilitating fitting of the pad member 30 to the bra 20 and thus opposite ends of the pad member 30 extend substantially equal distances outwardly from the center portion of the top edge of the pad member 30.

The pad member 30 is formed by a plurality of layers 38 of an absorbent material. The absorbent material is a cotton fiber The junction between each side of an upper edge of the pad member 30 and the notch 36 is generally arcuate for facilitating comfortable positioning of the notch 36 against the torso of the wearer.

Opposite end edges of the pad member 30 are generally arcuate for facilitating comfortable positioning of the opposite end edges against the torso of the wearer.

The pad member 30 includes a length thus each of the opposite end edges is positioned substantially aligned with an associated side of the bra 20 such that the pad member 30 covers a front hemisphere of the torso of the wearer of the bra 20.

In use, The user removes the backing member from the pad member. The user then aligns the V-shaped notch with the interior medial portion of the pair of cups of the bra. The user then presses the first face of the pad against the interior surface of the bra. The user then wears the bra in the conventional manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An absorbent pad comprising:

an elongate pad member formed from an absorbent material;

said pad member having a notch extending from a medial portion of a top edge of said pad member such that said notch is adapted for aligning between the pair of cups of the bra;

said notch being generally V-shaped; and a junction between each side of an upper edge of said pad member and said notch being generally arcuate.

2. The absorbent pad of claim 1, further comprising:

an adhesive coupled to a first face of said pad member whereby said first face of said pad member is adapted for removably coupling to a lower front edge of a bra such that a second face of said pad member is positioned to abut a torso of a wearer of the bra.

3. The absorbent pad member of claim 1, further comprising:

said absorbent material being a cotton fiber.

4. The absorbent pad member of claim 1, further comprising:

said pad member being formed by a plurality of layers of said absorbent material.

5. An absorbent pad comprising:

an elongate pad member formed from an absorbent material;

said pad member having a notch extending from a medial portion of a top edge of said pad member such that said notch is adapted for aligning between the pair of cups of the bra; and opposite ends of said pad member being generally arcuate for facilitating comfortable positioning of said opposite ends against the torso of the user.

6. The absorbent pad member of claim 2, further comprising:

said absorbent material being a cotton fiber.

7. The absorbent pad member of claim 2, further comprising:

said pad member being formed by a plurality of layers of said absorbent material.

8. The absorbent pad of claim 2, further comprising:

a backing member removably coupled to said first face of said pad member for covering said adhesive to preserve said adhesive prior to said pad member being coupled to the bra.

9. The absorbent pad of claim 1, further comprising:

an adhesive coupled to a first face of said pad member whereby said first face of said pad member is adapted for removably coupling to a lower front edge of a bra such that a second face of said pad member is positioned to abut a torso of a wearer of the bra;

a backing member removably coupled to said first face of said pad member for covering said adhesive to preserve said adhesive prior to said pad member being coupled to the bra;

said notch of said pad member being a single notch extending from said medial portion of said top edge of said pad member such that said single notch is adapted for aligning between the pair of cups of the bra;

said absorbent material being a cotton fiber;

said pad member being formed by a plurality of layers of said absorbent material;

said junction being for facilitating comfortable positioning of said notch against the torso of the wearer; and opposite ends of said pad member being generally arcuate for facilitating comfortable positioning of said opposite ends against the torso of the wearer.

10. An absorbent pad and bra system comprising:

a bra adapted for wearing by a human, said bra having a lower front edge adapted for positioning against a torso of a wearer beneath breasts of the wearer;

an elongate pad member formed from an absorbent material;

an adhesive coupled to a first face of said pad member for removably coupling said first face to said lower front edge of said bra such that a second face of said pad member is positioned to abut the torso of a wearer of the bra beneath breasts of the wearer;

a backing member removably coupled to said first face of said pad member for covering said adhesive to preserve said adhesive prior to said pad member being coupled to said bra;

said pad member having a single notch extending inwardly from a center portion of a top edge of said pad member, said notch being for aligning between the pair of cups of the bra for facilitating fitting of said pad member to said bra and whereby opposite ends of said pad member extend substantially equal distances outwardly from said center portion of said top edge of said pad member;

said absorbent material being a cotton fiber;

said pad member being formed by a plurality of layers of said absorbent material;

said notch being generally V-shaped;

a junction between each side of an upper edge of said pad member and said notch being generally arcuate for facilitating comfortable positioning of said notch against the torso of the wearer;

opposite end edges of said pad member being generally arcuate for facilitating comfortable positioning of said opposite end edges against the torso of the wearer; and said pad member having a length whereby each of said opposite end edges is positioned substantially aligned with an associated side of said bra such that said pad member covers a front hemisphere of the torso of the wearer of the bra.

11. The absorbent pad of claim 5, further comprising:

an adhesive coupled to a first face of said pad member whereby said first face of said pad member is adapted for removably coupling to a lower front edge of a bra such that a second face of said pad member is positioned to abut a torso of a wearer of the bra.

12. The absorbent pad member of claim 5, further comprising:

said absorbent material being a cotton fiber.

13. The absorbent pad member of claim 5, further comprising:

said pad member being formed by a plurality of layers of said absorbent material.

14. The absorbent pad member of claim 11, further comprising:

said absorbent material being a cotton fiber.

15. The absorbent pad member of claim 11, further comprising:

said pad member being formed by a plurality of layers of said absorbent material.

16. The absorbent pad of claim 11, further comprising:

a backing member removably coupled to said first face of said pad member for covering said adhesive to preserve said adhesive prior to said pad member being coupled to the bra.

* * * * *